US007570219B1

(12) United States Patent
Paulsen et al.

(10) Patent No.: US 7,570,219 B1
(45) Date of Patent: Aug. 4, 2009

(54) CIRCULAR POLARIZATION ANTENNA FOR PRECISION GUIDED MUNITIONS

(75) Inventors: Lee M. Paulsen, Cedar Rapids, IA (US); Brian J. Herting, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 11/435,090

(22) Filed: May 16, 2006

(51) Int. Cl.
*H01Q 1/28* (2006.01)
*H01Q 1/40* (2006.01)

(52) U.S. Cl. ..... 343/708; 343/873

(58) Field of Classification Search ..... 343/700 MS, 343/705, 708, 873
See application file for complete search history.

(56) References Cited

U.S. PATENT DOCUMENTS 5,986,616 A * 11/1999 Edvardsson ..... 343/853
6,344,833 B1 * 2/2002 Lin et al. ..... 343/846
6,452,565 B1 * 9/2002 Kingsley et al. ..... 343/873

* cited by examiner

*Primary Examiner*—Michael C Wimer
(74) *Attorney, Agent, or Firm*—Daniel M. Barbieri

(57) ABSTRACT

The present invention is an improved antenna system. In an embodiment of the invention, the antenna system of the present invention may be a dielectric resonator antenna which may include a dielectric cap that may surround a plurality of feed probes. The antenna system may be suitable for coupling to a projectile whereby the dielectric cap forms a front end, or nose, of the projectile. The plurality of feed probes may produce orthogonal vector components of a field to provide circular polarization. Additionally, feed probes may be optimally spaced within the dielectric cap to ensure the phase center of the antenna system may be co-located with a platform axis of rotation whereby no carrier phase rollup compensation may be required.

9 Claims, 5 Drawing Sheets

CIRCULAR POLARIZATION ANTENNA FOR PRECISION GUIDED MUNITIONS

FIELD OF THE INVENTION

The present invention relates generally to antenna technology, and more particularly to a circular polarization antenna and feed network system.

BACKGROUND OF THE INVENTION

Conventional weapon systems, including missiles, bombs and artillery shells, may be equipped with a terminal guidance system. A terminal guidance system may refer to an electronic system which may guide a weapon toward a designated target in the last phase of deployment prior to impact. Weapons which employ a terminal guidance system, such as a global positioning system (GPS) receiver, may be referred as precision guided munitions (PGMs). Advantageously, PGMs increase the percentage of enemy targets being destroyed while reducing collateral damage.

A problem associated with PGMs is the lack of coordinate reception capability during adverse weather conditions. For example, if a PGM is deployed in adverse weather conditions, the on-board GPS receiver may be unable to receive signals from GPS satellites. As a result, the PGM may be unable to determine its current GPS coordinates or determine the correct path to strike a desired target. Conventional antenna systems have been employed with PGMs to increase reception capability, but are limited by a number of factors. One type of conventional antenna system is a top-loaded monopole antenna as shown in FIG. 1. The top-loaded monopole antenna is typically placed on the nose of the weapon. The top-loaded monopole antenna is linearly polarized, creates back-looking radiation and suffers from a null in the forward direction along with pattern ripple in azimuth. Another type of conventional antenna system is a fuselage patch antenna 200 which is placed along a side of a weapon as shown in FIG. 2. A fuselage patch antenna, also known as a microstrip antenna, is typically placed on a ground plane of the weapon. A problem associated with a fuselage patch antenna is carrier phase rollup. When a weapon is deployed, a weapon may be spinning which causes a carrier phase rollup. Mitigation of the carrier phase rollup may require the addition of costly hardware/software implementations. Consequently, an improved antenna system is necessary.

SUMMARY OF THE INVENTION

Accordingly, the present invention is directed to an improved antenna system. In an embodiment of the invention, the antenna system of the present invention may be a dielectric resonator antenna which may include a dielectric cap that may surround a plurality of feeds, such as probes. The antenna system may be suitable for coupling to a projectile, whereby the antenna system including the dielectric cap forms a front end, or nose, of the projectile, the projectile itself serving as a ground plane for the dielectric resonator antenna. The plurality of feeds may produce orthogonal vector components of a field to provide circular polarization. Additionally, feeds may be optimally spaced within the dielectric cap to ensure the phase center of the antenna system may be co-located with a platform axis of rotation of the projectile whereby no carrier phase rollup compensation may be required.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to a presently preferred embodiment of the invention, an example of which is illustrated in the accompanying drawings.

Referring generally to FIGS. 3-8, multiple embodiments of an antenna system in accordance with the present invention are shown. In one embodiment of the invention, the antenna system may be formed of a dielectric resonator antenna which may include a dielectric cap that may surround a plurality of feeds. The antenna system may be suitable for coupling to a projectile. For example, the dielectric cap may form a front end, or nose, of the projectile. Advantageously, the projectile may serve as a ground plane for the dielectric resonator antenna. A projectile may be includes a weapon, artillery shell, missile, bomb and the like. The plurality of feeds may produce orthogonal vector components of a field to provide circular polarization. Additionally, feeds may be optimally spaced within the dielectric cap to ensure the phase center of the antenna system may be co-located with a platform axis of rotation of the projectile whereby no carrier phase rollup compensation may be required.

Figure 3:
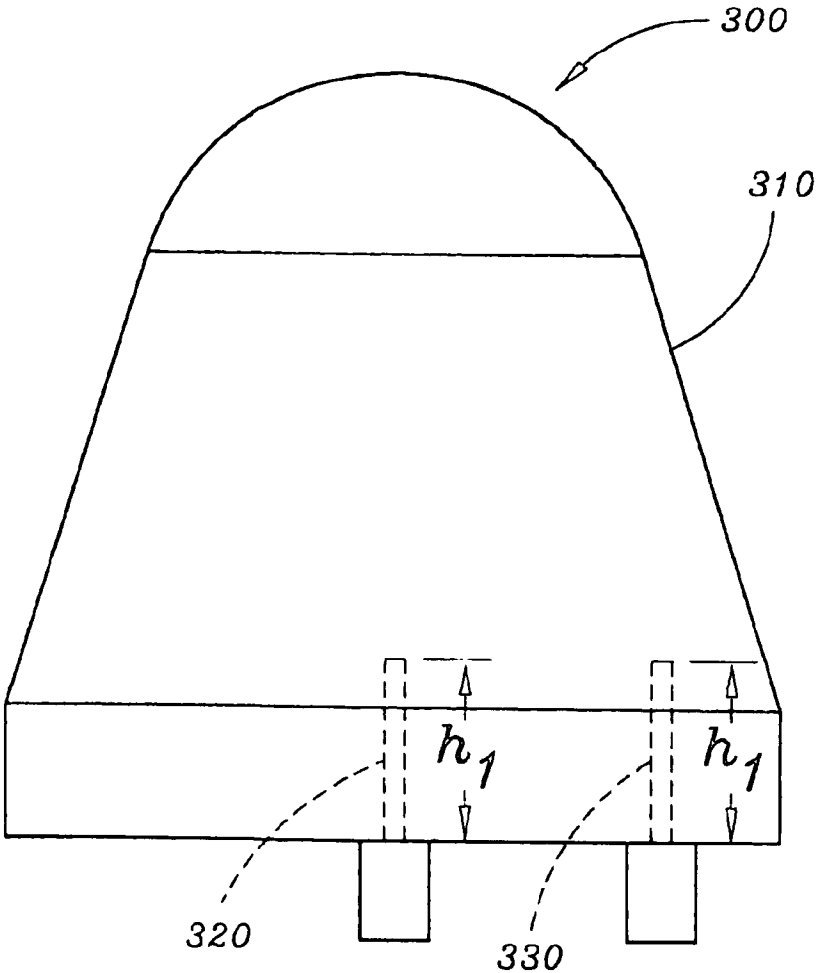
FIG. 3 depicts an antenna system in accordance with an embodiment of the present invention.

Referring specifically to FIG. 3, an antenna system 300 in accordance with an embodiment of the present invention is shown. Antenna system 300 may be a dielectric resonator antenna. A dielectric resonator antenna may include a dielectric cap 310 surrounding feeds 320, 330. A ground plane (not shown) may be coupled to the dielectric cap. In an embodiment of the invention, antenna system 300 may be coupled to a projectile whereby the projectile may serve as the ground plane for the dielectric resonator antenna.

In one embodiment of the invention, feeds 320-330 may comprise two feeds which may be driven in quadrature for exciting two orthogonal modes for omitting circularly polarized radiation. Feeds 320-330 may be 50 Ohm coaxial probes with high frequency coaxial connectors such as SMA fittings. Feeds 320-330 may extend a height h1 within the dielectric cap 310. Dielectric cap 310 may be formed of dielectric material providing an effective dielectric constant of 15. In operation of the antenna, probes may excite hybrid electrical and magnetic (HEM) modes inside the dielectric cap 310 which cause the probes to resonate.

In one embodiment of the invention, dielectric cap 310 may be cone-shaped. For example, the dielectric cone may be shaped according to optimal aerodynamic parameters with an ogive taper. However, it is contemplated that the shape of the dielectric cap 310 may be adjusted to alter the radiation pattern of the dielectric resonator antenna.

Figure 1:
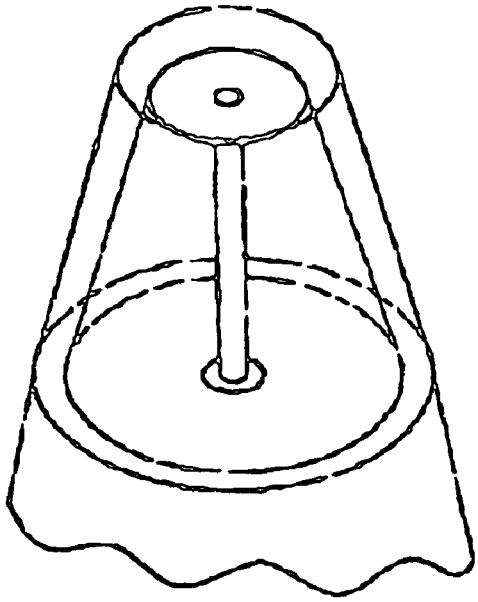
FIG. 1 (PRIOR ART)
FIG. 1 depicts a linearly polarized antenna placed within the nose of a weapon as known to the art.
Figure 2:
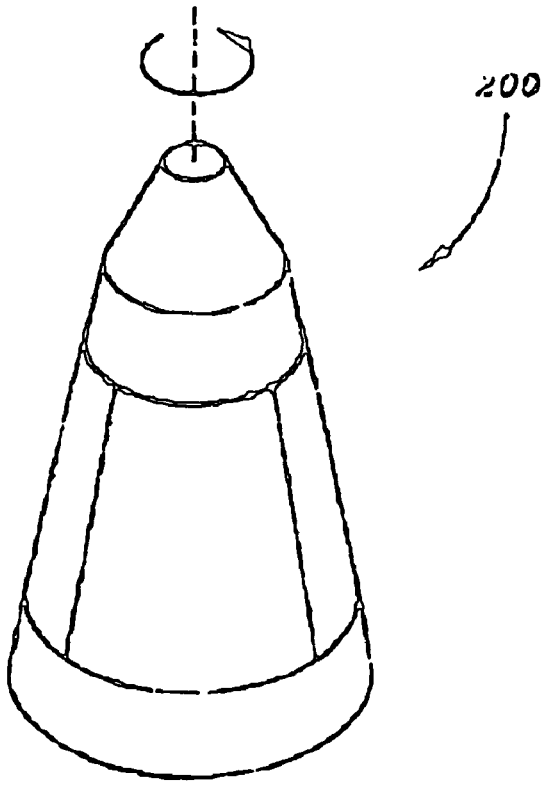
FIG. 2 (PRIOR ART)
FIG. 2 depicts a fuselage patch antenna placed on a ground plane of a weapon as known to the art.
Figure 4:
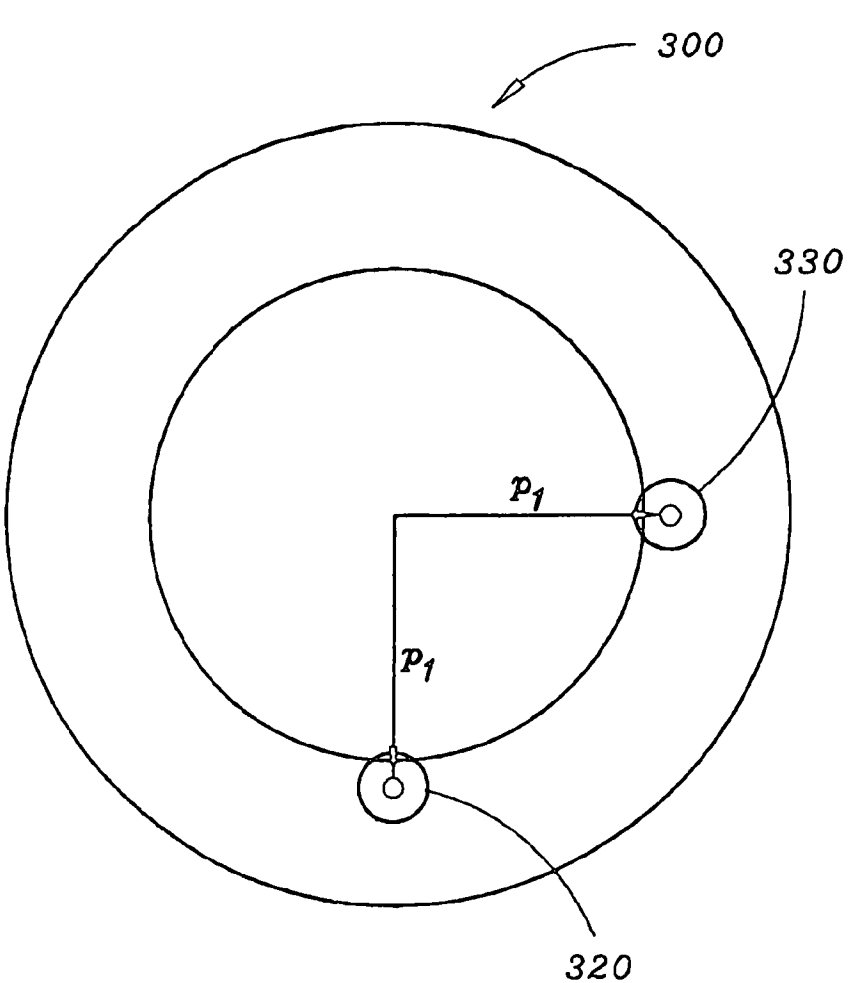
FIG. 4 depicts a bottom view of an antenna system in accordance with an embodiment of the present invention.

Referring to FIG. 4, a bottom view of antenna system 300 in accordance with an embodiment of the present invention is shown. In an embodiment of the invention, feeds 320-330 may be placed an equidistant distance (p1) from a center of the dielectric cap 310 and may be placed 90 degrees apart. By placing the probes an equidistant distance from a center of a symmetrically-shaped cap may lead to the phase center of the antenna to be tightly co-located with the axis of rotation of a projectile which is coupled to the antenna 300.

Figure 5:
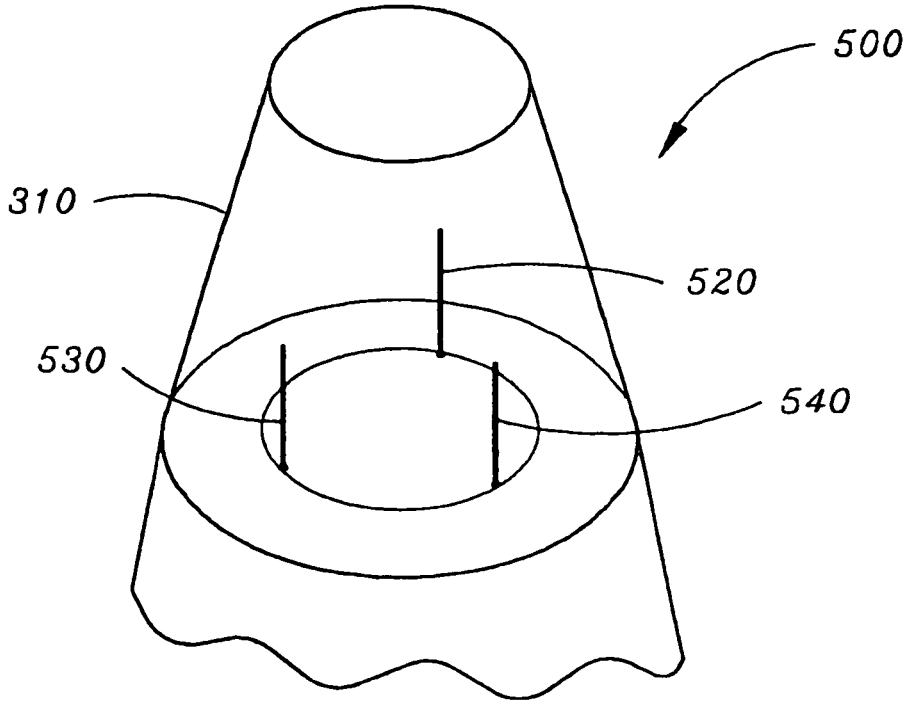
FIG. 5 depicts an antenna system in accordance with an alternative embodiment of the present invention.
Figure 6:
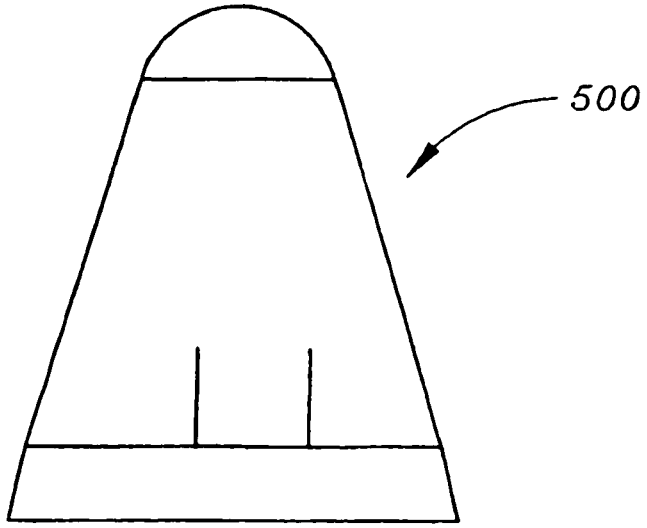
FIG. 6 depicts a side view of an antenna system in accordance with an alternative embodiment of the present invention.

Referring to FIGS. 5-6, an antenna system 500 in accordance with an alternative embodiment of the present invention is shown. Dielectric resonator antenna 500 may be substantially similar to antenna system 300 of FIGS. 3-4 with three feeds 520-540. Feed probes 520-540 may be placed an equidistant distance from a center of the dielectric resonator antenna 500. Additionally, feed probes 520-540 may be placed 120 degrees part and may be phased 120 degrees apart.

Figure 7:
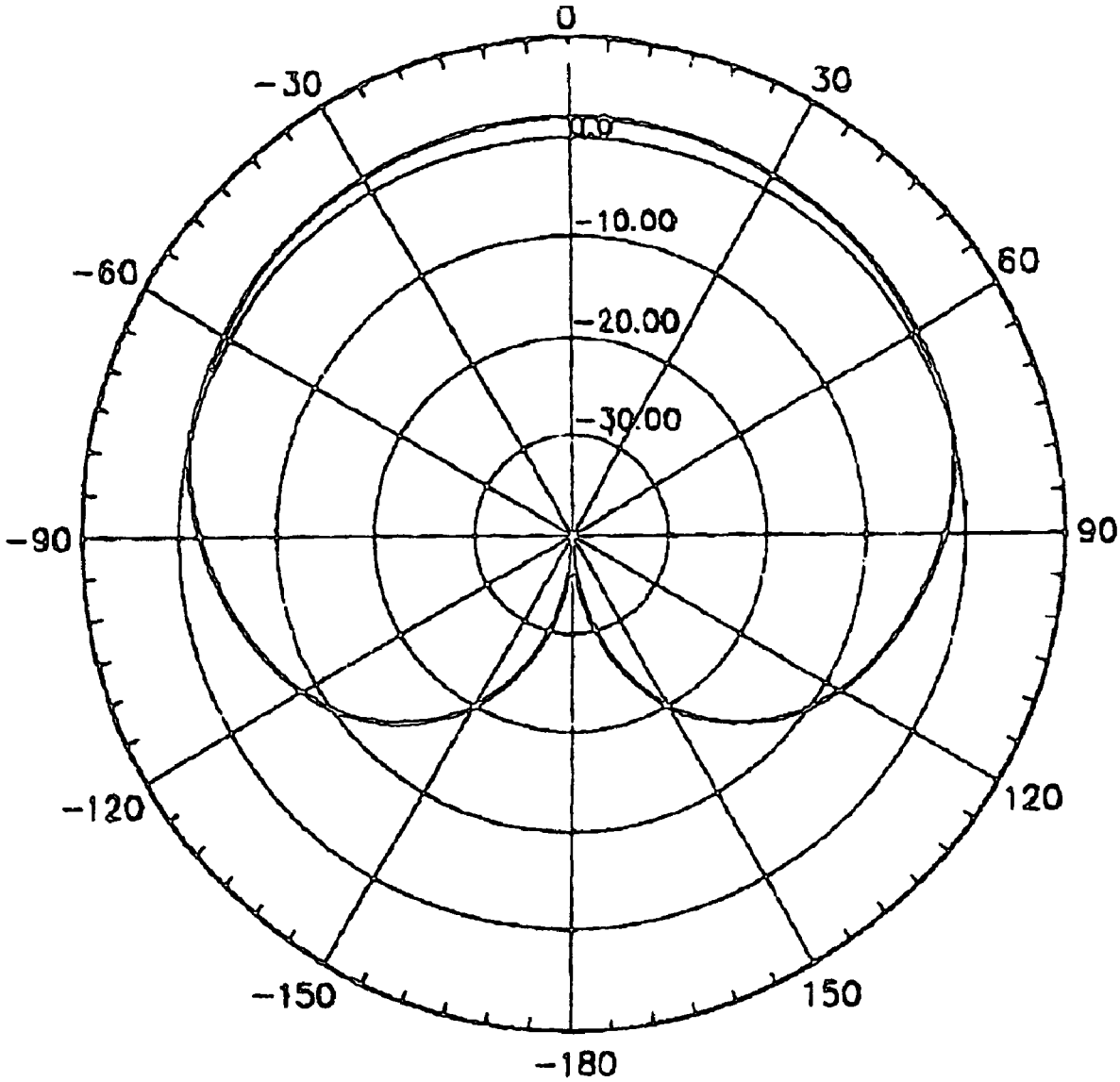
FIG. 7 depicts a forward-looking radiation pattern of the antenna system of FIGS. 5-6.
Figure 8:
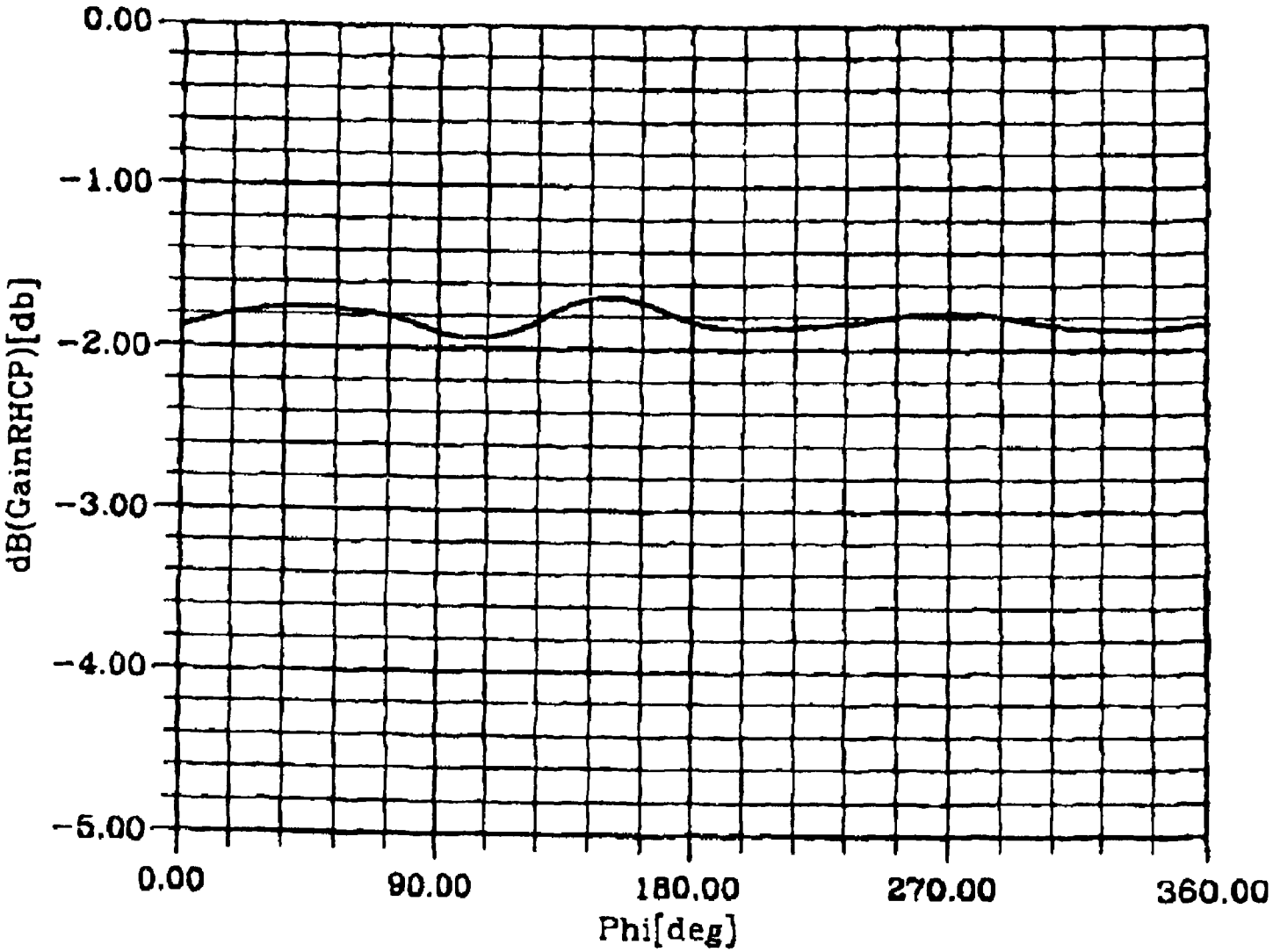
FIG. 8 depicts the low ripple in azimuth of the antenna system of FIGS. 5-6.

Antenna system 300, 500 may provide a number of advantages. For example, antenna systems 300, 500 may provide circular polarization radiation with a forward looking pattern. Such antenna systems 300, 500 may be ideal for global positioning system (GPS) fuze antennas. Referring to FIG. 7, an exemplary forward-looking radiation pattern 700 of the dielectric resonator antenna of FIGS. 5-6 is shown. Additionally, antenna systems 300, 500 may create low ripple pattern in azimuth. This may ensure small signal variation with roll angle. Referring to FIG. 8, an exemplary ripple pattern in azimuth of the dielectric resonator antenna of FIGS. 5-6 is shown.

It is contemplated that antenna system 300 may produce a slightly increased ripple pattern than antenna system 500. However, the software/hardware implementation for the three feed antenna system 500 may be more complex than the software/hardware implementation for the antenna system 200. It is further contemplated that multiple feeds, four feeds and greater, may also be employed by those with skill in the art without departing from the scope and intent of the present invention.

Additionally, antenna systems 300, 500 may employ commercially available polymer matrix and ceramic dielectric materials and may be manufactured within a small form factor. For example, by employing commercially available polymer matrix and ceramic dielectric materials with a dielectric constant of about 25, an antenna system 300, 500 may be produced in a 30 millimeter by 30 millimeter form factor. Thus, antenna systems 300, 500 may be employed with small projectiles, such as hand-held GPS-guided projectiles and the like.

It is contemplated that antenna system 300, 500 may be employed with a guided projectile. A guided projectile may refer to a weapon, artillery shell, missile, bomb and the like with a guidance system, such as a GPS receiver. In one embodiment of the invention, antenna system 300, 500 may be mounted to a projectile and may form the front end, or nose, of the guided projectile. Advantageously, antenna system 300, 500 may increase reception capability for the guidance system, such as a global positioning system receiver. Additionally, the phase center of the antenna system 300, 500 may be co-located with an axis of rotation of the guided projectile when the projectile is deployed. It is further contemplated that antenna system 300, 500 may be deployed with multiple types of applications without departing from the scope and intent of the present invention.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A guided projectile; comprising:

a projectile, said projectile including a global positioning system receiver and a housing; and a dielectric resonator antenna, said dielectric resonator antenna being coupled to said projectile wherein said housing of said projectile provides a ground plane for said dielectric resonator antenna, said dielectric resonator antenna comprising:

a plurality of feeds, said plurality of feeds including a first feed, a second feed and a third feed;

a dielectric cap surrounding said plurality of feeds and coupled to said housing of said projectile, said dielectric cap being conical-shaped and forming a front end nose of said projectile, said plurality of feeds being placed an equidistant distance from a center of the dielectric cap, wherein said plurality of feeds are capable of exciting two orthogonal modes for emitting circularly polarized radiation, said second feed being placed approximately 120 degrees from said first feed, said third feed being placed approximately 120 degrees from said second feed, said second feed being phased approximately 120 degrees differently than said first feed; said third feed being phased approximately 120 degrees differently than said second feed.

2. The guided projectile as claimed in claim 1, wherein said projectile includes a weapon, artillery shell, missile and bomb.

3. The guided projectile as claimed in claim 1, wherein said dielectric resonator antenna increases reception capability for said global positioning system receiver.

4. The guided projectile as claimed in claim 3, wherein a phase center of said dielectric resonator antenna is co-located with an axis of rotation of said projectile when projectile is deployed.

5. The guided projectile as claimed in claim 1, wherein said plurality of feeds are coaxial probes.

6. The guided projectile as claimed in claim 5, wherein said coaxial probes are approximately 50 Ohm coaxial probes.

7. The guided projectile as claimed in claim 1, wherein said dielectric resonator antenna is manufactured within an approximately 30 millimeter by 30 millimeter form factor.

8. The guided projectile as claimed in claim 7, wherein said dielectric cap has a dielectric constant of about 25.

9. The guided projectile as claimed in claim 8, wherein said projectile is a hand-held projectile.

* * * * *